US006383022B1

(12) United States Patent
Murakami et al.

(10) Patent No.: US 6,383,022 B1
(45) **Date of Patent: *May 7, 2002**

(54) WATERPROOF CONNECTOR

(75) Inventors: Takao Murakami; Masaru Fukuda, both of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/590,095

(22) Filed: Jun. 9, 2000

(30) Foreign Application Priority Data

Jun. 10, 1999 (JP) ..... 11-164155

(51) Int. Cl.[7] ..... H01R 13/40; H01R 13/52
(52) U.S. Cl. ..... 439/589; 439/274
(58) Field of Search ..... 439/587, 589, 439/274, 588, 556, 272, 275

(56) References Cited

U.S. PATENT DOCUMENTS 5,145,410 A * 9/1992 Maejima et al. ..... 439/274
5,299,949 A 4/1994 Fortin
5,472,352 A * 12/1995 Nishide et al. ..... 439/587
5,645,451 A 7/1997 Ohsumi et al.

FOREIGN PATENT DOCUMENTS

JP 9-73947 3/1997 ..... H01R/13/52
JP 11-329571 11/1999 ..... H01R/13/52

* cited by examiner

*Primary Examiner*—Gary Paumen
*Assistant Examiner*—Felix O. Figueroa
(74) *Attorney, Agent, or Firm*—Sughrue Mion, PLLC

(57) ABSTRACT

A connector housing has a plurality of chambers for respectively receiving an electric wire. A rubber mat plug has a plurality of bores respectively associated with the chambers. A front face of the rubber mat plug is attached to a rear end portion of the connector housing. A recess portion is formed on a rear face of the rubber mat plug so as to surround the bores while remaining cylindrical wall portions surrounding the respective bores. A plug holder presses the rear face of the rubber mat plug against the connector housing to hold the rubber mat plug thereon. A plurality of projections are formed on a front portion of the plug holder and inserted into the recess portion to compress at least an outer peripheral face of the respective cylindrical wall portions so that a compressive force in a radial direction of the bores is generated to increase a sealing ability between the rubber mat plug and the electric wires passed through the bores.

3 Claims, 3 Drawing Sheets

WATERPROOF CONNECTOR

BACKGROUND OF THE INVENTION

The present invention relates mainly to a waterproof connector to be employed for connecting wire harnesses in an automobile.

FIGS. 3A–3C show a related waterproof connector as disclosed in Japanese Patent Publication No. 9-73947A. In FIG. 3C, reference numeral 1 represents a connector housing, 2 represents a rubber plug, and 3 represents a rubber plug holder.

As shown in FIGS. 3A and 3B, the rubber plug holder 3 and the rubber plug 2 are respectively provided with a plurality of through holes 5 and 7 in vertically arranged two rows which correspond to terminal receiving chambers formed in the housing 1 such that electric wires are passed through. At a rear face of the rubber plug 2, are provided three rectilinear slits 6 so as to interpose the two rows of the through holes 5 therebetween. At a front face of the rubber plug holder 3, are projectingly provided pressing plates 8 in a form of a flat plate which are adapted to be inserted into the slits 6 respectively.

In this waterproof connector, by inserting the pressing plates 8 into the slits 6 formed in the rubber plug 2 as shown in FIG. 3C, a compressive force is exerted on the rubber plug 2 increasing pressures around electric wires W so as to enhance a waterproofing property.

However, in the above described related waterproof connector having such a structure that the pressing plates 8 in a form of a flat plate are inserted into the rectilinear slits 6, a distribution of pressures around each of the electric wires W (a length of an arrow mark in the drawing represents, magnitude of the pressure) has not been uniform as shown in FIG. 3D. In other words, the pressures are larger at positions where the pressing plates 8 exist above and below, while the pressures are smaller at positions where the pressing plate 8 does not exist on the left and right hands, and a uniform distribution of the pressures has been unable to be obtained. For this reason, the related waterproof connector could not attain the waterproofing property of high performance.

SUMMARY OF THE INVENTION

Considering the above described circumstances, it is an object of the invention to provide a waterproof connector which can enhance the waterproofing property by equalizing the pressure distribution around an electric wire.

In order to achieve the above object, according to the present invention, there is provided a waterproof connector comprising:

- a connector housing having a plurality of chambers for respectively receiving an electric wire;
- a rubber mat plug having a plurality of bores respectively associated with the chambers, the rubber mat plug a front face of which is attached to a rear end portion of the connector housing;
- a recess portion formed on a rear face of the rubber mat plug so as to surround the bores while remaining cylindrical wall portions surrounding the respective bores;
- a plug holder for pressing the rear face of the rubber mat plug against the connector housing to hold the rubber mat plug thereon; and
- a plurality of projections formed on a front portion of the plug holder and inserted into the recess portion to compress at least an outer peripheral face of the respective cylindrical wall portions so that a compressive force in a radial direction of the bores is generated to increase a sealing ability between the rubber mat plug and the electric wires passed through the bores.

Accordingly, the pressure distribution around the electric wire can be made uniform to the most, whereby the waterproofing function of high performance can be realized.

Preferably, the adjacent cylindrical wall portions are partly connected with each other.

Since the pitch between the bores can be minimized, although each of the cylindrical wall portions is not in a perfectly independent cylindrical form. Therefore, the compact waterproof connector can be realized.

Preferably, the respective cylindrical wall portions are formed so as to receive the compressive force from the projections at four portions situated on two orthogonal lines intersecting at the center of the respective bores.

Since each of the cylindrical wall portions receives the compressive forces in the four directions at the interval of 90 degree, the compressive forces can be exerted on the electric wire in a good balance.

BRIEF DESCRIPTION OF THE DRAWINGS

FIG. 1B is a sectional view taken along the line 1B—1B of FIG. 1A;

FIG. 2A is a sectional side view showing the waterproof connector in a condition before assembly;

FIG. 2B is a sectional view taken along the line 2B—2B of FIG. 2A, showing the connector in a condition where the rubber plug is fitted in a connector housing.

DETAILED DESCRIPTION OF THE PREFERRED EMBODIMENTS

Now, one embodiment according to the invention will be described with reference to the accompanying drawings.

Figure 1A:
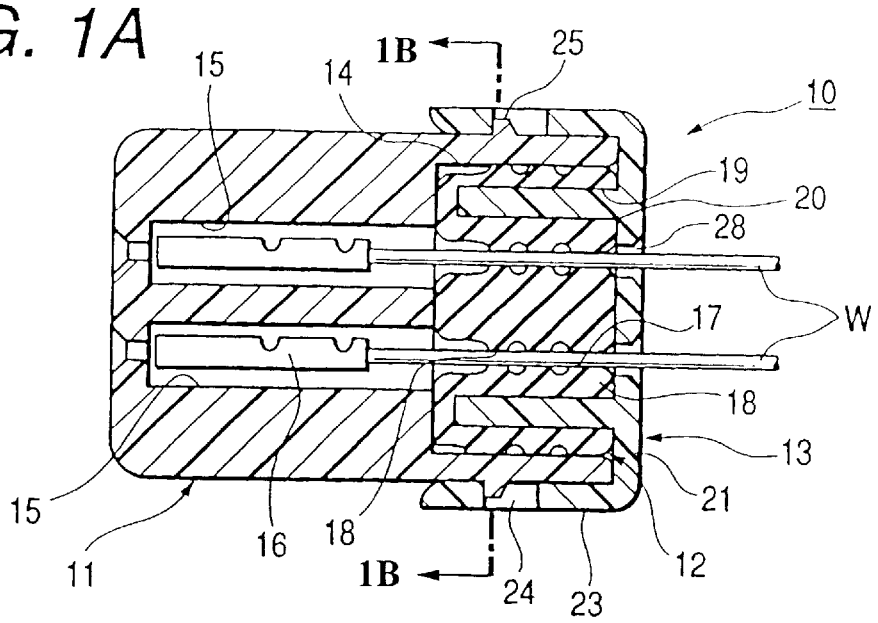
FIG. 1A is a sectional side view of a waterproof connector according to an embodiment of the invention.
Figure 1B:
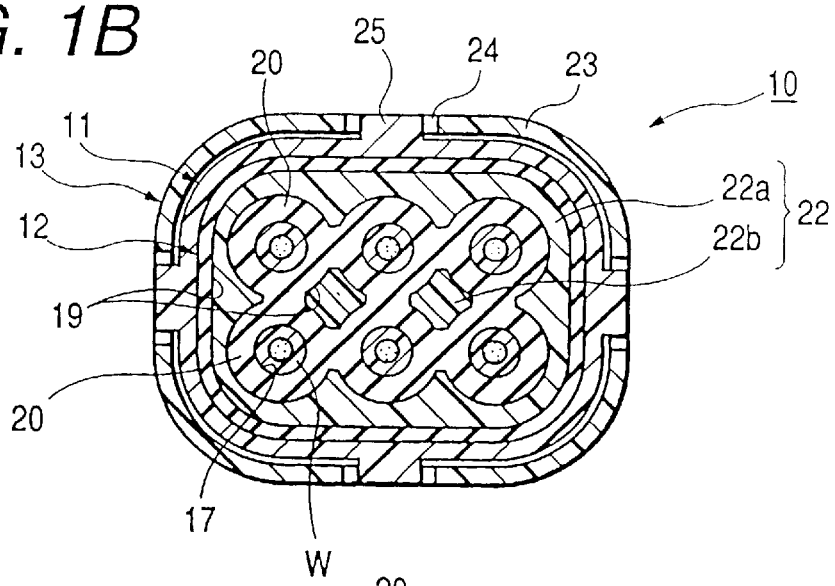
FIG. 1B is a sectional view taken along the line A—A of FIG. 1A.
Figure 1C:
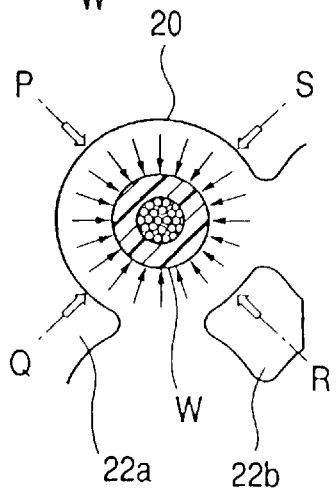
FIG. 1C is an enlarged view of the essential part of FIG. 1B.
Figure 2A:
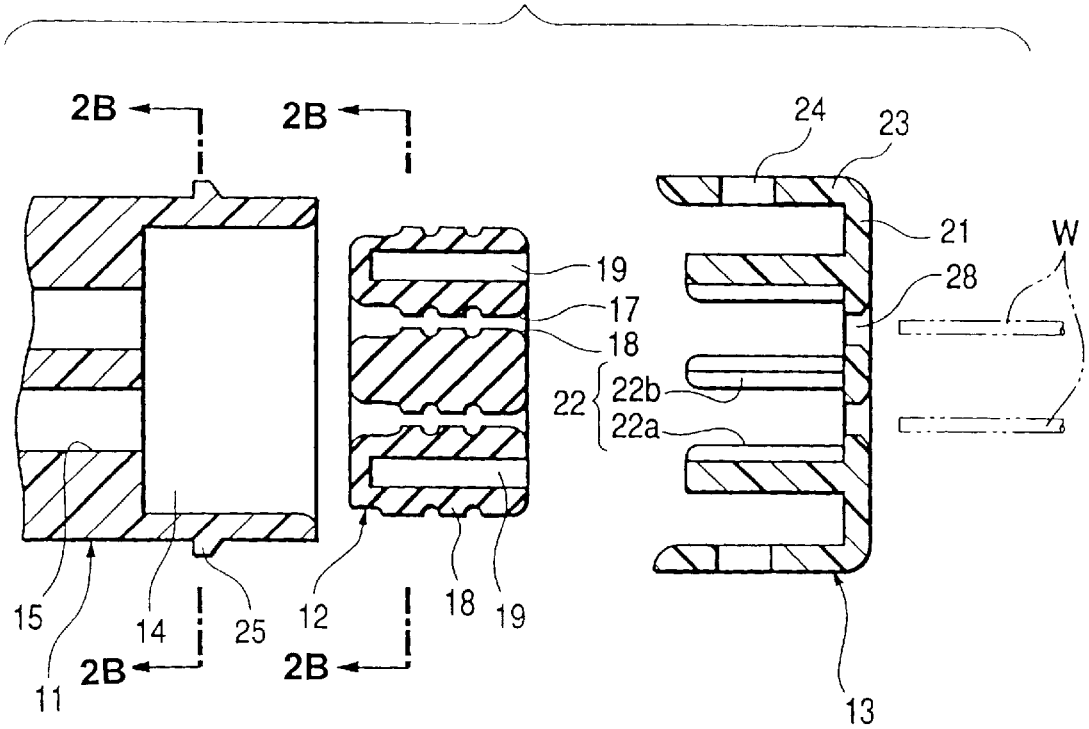
FIG. 2A is a sectional side view showing the waterproof connector in a condition before assembled.
Figure 2B:
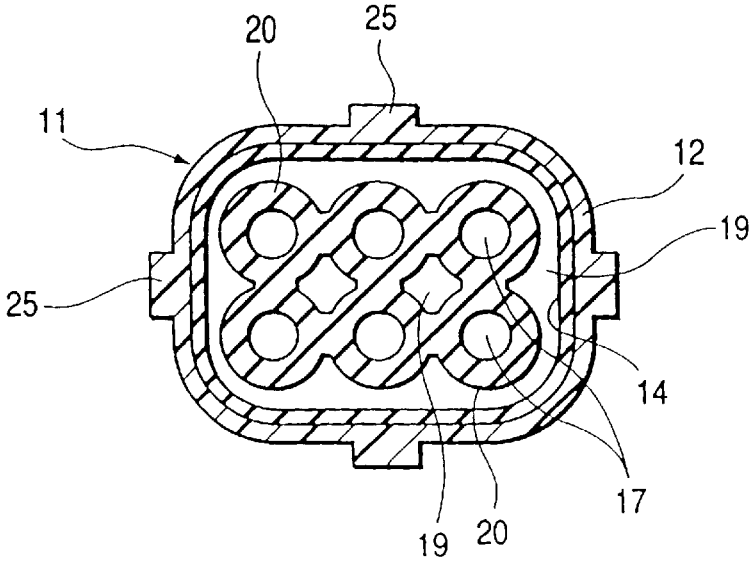
FIG. 2B is a sectional view taken along the line B—B of FIG. 2A, showing the connector in a condition where a rubber plug is fitted in a connector housing.
Figure 3A:
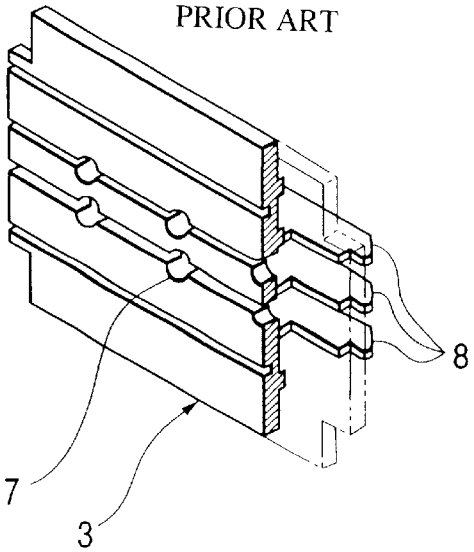
FIG. 3A PRIOR ART
FIG. 3A is a perspective view of a rubber plug holder of a related waterproof connector.
Figure 3B:
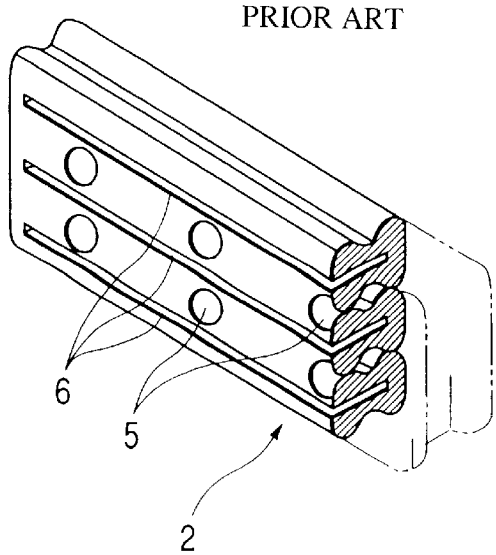
FIG. 3B PRIOR ART
FIG. 3B is a perspective view of a rubber plug of the related waterproof connector.
Figure 3C:
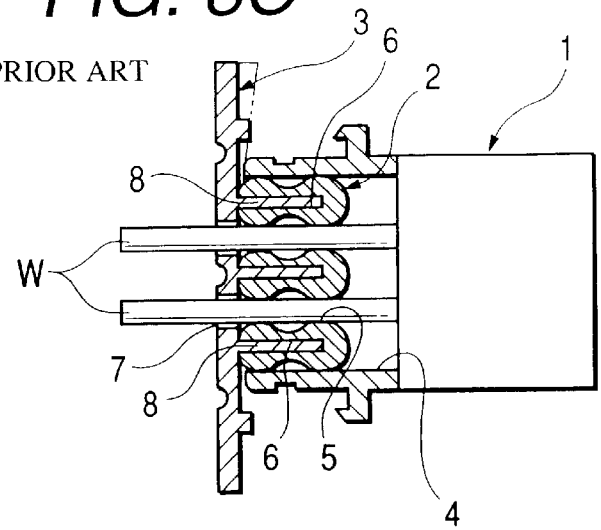
FIG. 3C PRIOR ART
FIG. 3C is a sectional side view showing the related waterproof connector while assembled.
Figure 3D:
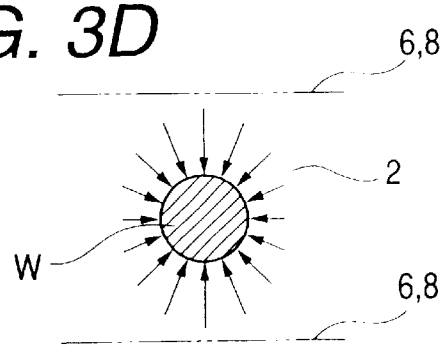
FIG. 3D PRIOR ART
FIG. 3D is an enlarged view showing a pressure distribution around an electric wire of FIG. 3C.

FIG. 1A is a sectional side view of a waterproof connector according to an embodiment of the invention. FIG. 1B is a sectional view taken along the line 1B—1B of FIG. 1A. FIG. 1C is an enlarged view of the essential part of FIG. 1B. FIG. 2A is a sectional side view showing the waterproof connector in a condition before assembly. FIG. 2B is a sectional view taken along the line 2B—2B of FIG. 2A, showing the connector in a condition where the rubber plug is fitted in a connector housing.

This waterproof connector 10 consists of a connector housing 11 formed of a hard synthetic resin, an integrally molded rubber plug 12 in a form of a mat, and a rubber plug holder 13 which is formed of a hard synthetic resin and adapted to press the rubber plug 12 against the connector housing 11. Material of the rubber plug 12 is not necessarily limited to rubber in a strict sense, but it may be rubber-like material having resiliency. For example, the plug 12 may be formed of a soft resin.

The connector housing 11 includes a plurality of terminal receiving chambers 15 for receiving terminals 16 attached to distal ends of electric wires W, and is also provided with an engaging recess 14 for receiving the rubber plug 12 at a rear face thereof. At an outer periphery of the housing 11, are formed locking projections 25 for locking the rubber plug holder 13 when the rubber plug holder 13 is fitted to the housing 11.

The rubber plug 12 is in a form of a thick mat and has a plurality of bores 17 corresponding to the terminal receiving chambers 15 in the connector housing 11, through which the electric wires W are passed. The bores 17 pass through the rubber plug 12 from the rear face to the front face thereof. At an inner peripheral face of each of the bores 17, are provided a plurality of annular sealing ridges 18 in order to increase sealing ability with respect to the electric wire W. Similarly at an outer peripheral face of the rubber plug 12, are provided a plurality of the annular sealing ridges 18 in order to increase the sealing ability with respect to the engaging recess 14 in the connector housing 11.

At the rear face of the rubber plug 12, are formed recess portions 19 so as to surround the bores 17 concentrically, leaving cylindrical wall portions around the bores 17. In this case, the cylindrical wall portions 20 formed by the recess portions 19 are not in a form of a perfectly independent cylinder, because the adjacent cylindrical Wall portions 20 are connected to each other.

As shown in FIG. 1C in an enlarged scale, the portions to be connected between the two adjacent cylindrical wall portions 20 are restrictedly provided in such a manner that each of the cylindrical wall portions 20 is exposed at its outer peripheral portions in diametrical four directions P, Q, R and S which intersect at right angles with each other. In short, at the four positions equidistantly arranged at 90 degree in a circumferential direction, at least the outer peripheral portions of the cylindrical wall portion 20 are formed in an open state.

The rubber plug holder 13 has a back wall 21 of a size for covering the rubber plug 12, and through holes 28, through which electric wires are passed, are formed in the back wall 21 correspondingly to the bores 17 in the rubber plug 12. In front of the back wall 21 are formed pressing projections 22 which are adapted to be press-fitted in the recess portions 19 in the rubber plug 12. The pressing projections 22 include a frame-like pressing projection 22*a* at an outer peripheral side and pillar-like pressing projections 22*b* so that all the exposed outer peripheral portions of the cylindrical wall portions 20 of the rubber plug 12 can be pressed without omission.

These pressing projections 22*a* and 22*b* are formed rather larger than the recess portions 19 in order to exert compressive forces with respect to the rubber plug 12 in a radial direction of the bore 17 when they are press-fitted into the recess portions 19. By inserting the pressing projections 22*a*, 22*b* into the recess portions 19, the outer peripheral portions of the cylindrical wall portions 20 which are exposed in the recess portions 19 are uniformly pressed.

Further, the rubber plug holder 13 includes a frame portion 23 at its outer peripheral part which is adapted to be fitted to an outer periphery of the rear end of the connector housing 11. The frame portion 23 is provided with locking holes 24 to be engaged with the locking projections 25 of the connector housing 11.

In order to assemble this waterproof connector 10, the terminals 16 fixed to the distal ends of the electric wires W are passed through the through holes 28 in the rubber plug holder 13 and the bores 17 in the rubber plug 12 in order. Then, the terminals 16 passed through the rubber plug holder 13 and the rubber plug 12 are inserted into the terminal receiving chambers 15 in the connector housing 11 from the back. The rubber plug 12 has been previously fitted into the engaging recess 14 in the connector housing 11 as shown in FIG. 2B. Otherwise, the rubber plug 12 may be fitted into the connector housing 11, after the terminals 16 have been inserted into the terminal receiving chambers 15.

After the terminals 16 and the rubber plug 12 have been thus mounted on the connector housing 11, the rubber plug holder 13 is fitted to the rear end of the connector housing 11 with the locking projections 25 engaged with the locking holes 24, pressing the rubber plug 12 against the connector housing 11.

On this occasion, the pressing projections 22 formed in front of the rubber plug holder 13 are press-fitted in the recess portions 19 formed in the rear face of the rubber plug 12, whereby the compressive forces in radial directions of the bore 17 are exerted on the rubber plug 12, and the sealing ability between the electric wire W passed through the bore 17 and the rubber plug 12 will be increased by the compressive forces.

Especially, because the recess portions 19 into which the pressing projections 22 are press-fitted are concentrically formed with each of the bores 17 so as to surround the bores 17, the cylindrical wall portions 20 around the bores 17 are evenly pressed from the outer peripheral portions. Accordingly, substantially uniform compressive forces are exerted on the electric wire W from the cylindrical wall portions 20 along the entire circumference of the bores 17. As shown in FIG. 1C, since the cylindrical wall portions 20 surrounding the bores 17 are not in a perfect cylindrical shape, the pressing forces of the pressing projections 22 are usually difficult to be exerted on the connected portions between the adjacent cylindrical wall portions (this can be noted because the arrow marks representing the magnitude of the pressures are smaller). However, according to the invention, the pressing forces (represented by bold arrows) can be exerted on the cylindrical wall portion 20 from the four positions P, Q, R, and S at an interval of 90 degrees, and the pressing forces with respect to the electric wire W can be exerted in a good balance. Therefore, while intending to minimize a pitch between the bores 17 by connecting the adjacent cylindrical wall portions 20, the initial object of increasing the sealing ability can be attained. Further, the continued cylindrical wall portions 20 are advantageous in a viewpoint of strength and can afford an excellent moldability.

Further, although the adjacent cylindrical wall portions 20 are continuously formed in the above described embodiment, it is apparent that the cylindrical wall portions 20 can be formed in an independent cylindrical shape by keeping spaces therebetween or reducing thickness of the cylindrical wall portions 20. This can make the pressure distribution along the entire circumference perfectly uniform. In this case, however, the pitch between the bores 17 must be larger, or the thickness of the cylindrical wall portions 20 must be thinner. Therefore, it is desired that their values are set considering a balance in view of their dimensions and rigidities.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A waterproof connector comprising:

a connector housing having a plurality of chambers for respectively receiving electric wires inserted through a rear end portion of the connector housing;

a rubber mat plug having a plurality of bores respectively associated with the chambers for respectively receiving said electric wires, the rubber mat plug having a front face which is attatched to the rear end portion of the connector housing;

a recess portion formed on a rear face of the rubber mat plug so as to substantially surround the bores and defining cylindrical wall portions substantially surrounding each of the respective bores;

a plug holder for pressing the rear face of the rubber mat plug against the connector housing to hold the rubber mat plug thereon; and a plurality of projections formed on a front portion of the plug holder and inserted into the recess portion to compress an outer peripheral face of the respective cylindrical wall portions, each of the projections including a portion having a shape which constitutes a part of a concentric circle of an associated bore.

2. The waterproof connector as set forth in claim 1, wherein the adjacent cylindrical wall portions are partly connected with each other.

3. The waterproof connector as set forth in claim 1, wherein the respective cylindrical wall portions are formed so as to receive the compressive force from the projections at four portions situated on two orthogonal lines intersecting at the center of the respective bores.

* * * * *